US009198492B2

(12) United States Patent
Chehebar

(10) Patent No.: US 9,198,492 B2
(45) Date of Patent: Dec. 1, 2015

(54) LUGGAGE SYSTEM

(71) Applicant: Alfred Chehebar, New York, NY (US)

(72) Inventor: Alfred Chehebar, New York, NY (US)

( * ) Notice: Subject to any disclaimer, the term of this patent is extended or adjusted under 35 U.S.C. 154(b) by 134 days.

(21) Appl. No.: 13/679,339

(22) Filed: Nov. 16, 2012

(65) Prior Publication Data

US 2013/0126286 A1 May 23, 2013

Related U.S. Application Data

(60) Provisional application No. 61/560,922, filed on Nov. 17, 2011.

(51) Int. Cl.

| | |
|---|---|
| ***A45C 13/00*** | (2006.01) |
| ***A45C 13/02*** | (2006.01) |
| ***A45C 13/40*** | (2006.01) |

(52) U.S. Cl.

CPC ..... *A45C 13/00* (2013.01); *A45C 13/008* (2013.01); *A45C 13/02* (2013.01); *A45C 13/40* (2013.01); *A45C 2013/026* (2013.01); *A45C 2013/028* (2013.01)

(58) Field of Classification Search

CPC ..... A45C 7/0045; A45C 5/14; A45C 7/0086; A45C 5/00; A45C 3/00

USPC ..... 190/100–113, 18 A; 119/453, 474, 496, 119/497; 206/315.1, 315.5, 317, 524.8, 206/579; 224/231, 416, 638; 383/18, 37, 3; D3/279, 285

See application file for complete search history.

(56) References Cited

U.S. PATENT DOCUMENTS

| | | | | | |
|---|---|---|---|---|---|
| 4,236,615 | A | * | 12/1980 | Ginat | 190/111 |
| 4,506,769 | A | | 3/1985 | Franco et al. | |
| 4,538,709 | A | | 9/1985 | Williams et al. | |
| 4,756,394 | A | | 7/1988 | Cohen | |
| 5,769,028 | A | * | 6/1998 | Deckys | 119/496 |
| 6,155,206 | A | * | 12/2000 | Godshaw | 119/453 |
| 6,202,910 | B1 | | 3/2001 | Swetish | |
| 6,230,952 | B1 | | 5/2001 | Jupiter | |
| 6,305,590 | B1 | | 10/2001 | Hayes | |
| 6,408,872 | B1 | | 6/2002 | Skeens et al. | |
| 6,651,520 | B1 | * | 11/2003 | Allen et al. | 73/863.81 |

(Continued)

FOREIGN PATENT DOCUMENTS

| | | | |
|---|---|---|---|
| GB | 2318283 | A | 4/1998 |
| KR | 20090073438 | B1 | 10/2009 |

*Primary Examiner* — Fenn Mathew
*Assistant Examiner* — Cynthia Collado
(74) *Attorney, Agent, or Firm* — JP Webb; Jason P. Webb; Danny Y. H. Cheng

(57) ABSTRACT

There is a luggage system and a method of storing articles of clothing using a luggage system. The luggage system includes a luggage container. The luggage container includes a main access aperture and a secondary access aperture. The luggage container includes a sealing structure functionally coupled to the secondary access aperture. The luggage container includes a one-way valve disposed through the sealing structure and configured to permit air to exit the luggage system through the sealing structure. The luggage system includes a compression bag removably coupled to the luggage container. The compression bag includes a bag body of air impermeable material and a mouth. The luggage system includes a retaining system configured to retain the bag body when the bag body is in a rolled configuration. The retaining system includes a retaining strap selectably coupleable to one of the bag body and the luggage container.

20 Claims, 15 Drawing Sheets

(56) References Cited

U.S. PATENT DOCUMENTS

| | | | | |
|---|---|---|---|---|
| 6,729,473 | B2 | 5/2004 | Anderson | |
| 6,910,560 | B2 | 6/2005 | Dulin | |
| D507,111 | S | 7/2005 | Renz et al. | |
| D554,862 | S | 11/2007 | Hsieh | |
| 7,334,669 | B2 | 2/2008 | Barker et al. | |
| 7,452,132 | B2 | 11/2008 | Tang | |
| 7,513,481 | B2 | 4/2009 | Su | |
| 7,578,320 | B2 | 8/2009 | Borchardt | |
| D640,868 | S | 7/2011 | Jongchul | |
| 8,005,189 | B2 | 8/2011 | Ripp et al. | |
| 8,251,192 | B1 * | 8/2012 | Milani | 190/103 |
| 2002/0088679 | A1 | 7/2002 | Abraham | |
| 2004/0173427 | A1 | 9/2004 | Chernoff | |
| 2005/0098402 | A1 | 5/2005 | Cohen | |
| 2006/0272980 | A1 | 12/2006 | Montgomery | |
| 2007/0017765 | A1 * | 1/2007 | Robinson et al. | 190/110 |
| 2009/0080809 | A1 | 3/2009 | Pham et al. | |
| 2011/0056441 | A1 * | 3/2011 | Chang | 119/453 |

* cited by examiner

LUGGAGE SYSTEM

CROSS-REFERENCE TO RELATED APPLICATIONS

This invention claims priority, under 35 U.S.C. §120, to the U.S. Provisional Patent Application No. 61/560,922 to Alfred Chehebar filed on Nov. 17, 2011, which is incorporated by reference herein in its entirety.

BACKGROUND OF THE INVENTION

1. Field of the Invention

The present invention relates to luggage, specifically to a luggage system including a compression bag configured to permit the user to compress laundry during travel.

2. Description of the Related Art

Luggage or baggage is any number of bags, cases and containers which hold a traveler's personal articles during transit. Luggage is normally used in relation to the personal baggage of a specific person or persons. The modern traveler can be expected to have luggage including clothing, toiletries, small possessions, trip necessities, and on the return-trip, and souvenirs.

Luggage has changed over time. Historically the most common types of luggage were Chests or trunks made of wood or other heavy materials. These would be shipped by professional movers. Since the Second World War smaller and more lightweight suitcases and bags that can be carried by an individual have become the main form of luggage.

There are various types of luggage, an example of a type of luggage may be a suitcase. A suitcase is a general term that may refer to a wheeled or non-wheeled luggage, as well as soft or hard side luggage. Rolling luggage refers to various types of wheeled luggage either with or without telescoping handles. Typically two fixed wheels on one end with the handle located on the opposite for vertical movement. A wheeled upright is a relatively new type of luggage that incorporates an extending handle that allows the traveler to roll it in an upright position. Some types of luggage include wheels, wherein rolling suitcases have become increasingly popular over the last decade. Expandable luggage includes suitcases that can be unzipped to expand for more packing space.

Typically luggage is used during all phases of travel, including but not limited to travel by bus, shuttle, car, limo, taxi, plane, boat, and the like and combinations thereof as well as during temporary lodgings in hotels, motels, condos, homes, and the like and combinations thereof and even during meetings (business or otherwise). Accordingly, luggage may be called upon to perform a great variety of functions and may be needed to be appropriate in a great variety of settings.

Some improvements have been made in the field. Examples of references related to the present invention are described below in their own words, and the supporting teachings of each reference are incorporated by reference herein:

U.S. Pat. No. 8,005,189, issued to Ripp et al., discloses a piece of luggage, such as a suitcase, is constructed with one or more compartments of predesigned location and purpose to facilitate security inspection. Compartments may be designated to hold objects that, if obscured by other objects, carry an undesirably high likelihood of generating a false alarm because obscuring objects prevent an accurate assessment of the nature of those objects. For this reason, a compartment may be designated for liquids, gels and/or aerosols. A compartment may also be designated for objects, such as metal objects, which carry a risk of generating a false alarm if packed in a suitcase in a way that they obscure other objects and prevent an accurate determination of whether those objects are threat objects. Such compartments are positioned to ensure that the items they contain are segregated during x-ray inspection so as to neither obscure or be obscured by other objects packed in the luggage.

U.S. Pat. No. 7,578,320, issued to Borchardt, discloses a flexible bag including overlaying first and second sidewalls that provide an internal volume that can be accessed via an opening. To evacuate air from the internal volume after the open top edge has been closed, the bag includes a one-way valve element attached to the first sidewall. The bag is configured to prevent objects from clogging the valve element during evacuation. In one embodiment, the bag may include a plurality of ridges formed along the inner surface of at least one sidewall that can maintain separation of the sidewalls and contents from the valve element. In another aspect, the valve element is beneficially located at a top corner of the bag where the valve element is spaced apart from those locations in the bag where contents are likely to collect.

U.S. Pat. No. 7,513,481, issued to Su, discloses a one-way valve of a sealed bag to expel the dead air out from the bag with a preferred air-tight effect. The one-way valve comprises a valve seat, a diaphragm mounted inside the valve seat, the diaphragm is also in linear contact with a projected annular ring, a stop device pressed on the diaphragm, a valve cap screwed to the valve seat and pressed the stop device. Said valve cap has hooks adapted to apertures of the seat, thus keep the cap on the seat not to be separated from thereof. Moving upward or downward the valve cap, the stop device can be controlled to press onto the diaphragm tightly or become loose. An airtight effect is achieved with a pressure exerted between the stop device and the annular ring. Or one-way valve can expel the dead air through the air pores under diaphragm.

U.S. Pat. No. 3,452,132, issued to Tang, discloses a clothes storage bag permitting the stacking of clothes in standing position is comprised of two side plastic films and a base plastic film; both side films defining an erected storage case on the upper part; a zipper sealing being provided to an opening at the top of the erected storage case; the lower part of each erected film laterally extending in opposite directions to form a lateral storage case connecting through the erected storage case; and a passage to expel air being provided on either side of the lateral storage case to reduce bag size.

U.S. Pat. No. 7,334,669, issued to Barker et al., discloses Wheeled luggage having a telescopically expandable body is disclosed. The luggage body may be manually adjusted from a normally sized carry-on configuration during transit, to a vertically enlarged configuration once the final destination, such as a hotel room, is reached. The body further includes a plurality of interior horizontally disposed, vertically stacked shelves connected in accordion fashion to an internal liner so as to automatically expand from a compact configuration to an expanded configuration when the main body is telescopically expanded thereby providing a series of vertically spaced shelves which provide convenient access to the contents. A garment folding apparatus may be incorporated with the luggage to provide a tool that assists the user in quickly folding clothing to dimensions compatible with storage spaced within the luggage.

The inventions heretofore known suffer from a number of disadvantages which include being limited in use, being limited in function, being unable to store used or dirty articles of clothing, being expensive, being inconvenient, requiring the traveler to take extra steps to store laundry, being odorous, mixing clean and soiled clothing, storing soiled clothing in a manner that takes up too much space, making it difficult for travelers to continue to store clothing as a trip progresses, requiring travelers to completely open a bag to store or retrieve laundry stored therein, and the like and combinations thereof.

What is needed is a luggage system that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available luggage systems. Accordingly, the present invention has been developed to provide a luggage system including a compression bag.

According to one embodiment of the invention, there is a luggage system. The luggage system may include a luggage container. The luggage container may include a main cavity that may be configured to store items therein. The luggage container may include a main access aperture that may be in communication with the main cavity. The luggage container may include a secondary access aperture that may be in communication with the main cavity. The luggage container may include a sealing structure that may be functionally coupled to the secondary access aperture, such that the secondary access aperture may be selectably sealable thereby. The sealing structure may be a zipped flap.

The luggage container may include a valve that may be disposed through the sealing structure and may be a one-way valve that may be configured to permit air to exit the luggage system through the sealing structure when the sealing structure is sealed and may simultaneously prevent air from entering therethrough.

The luggage system may include a compression bag that may be disposed inside the main cavity and may be removably coupled to the luggage container. The compression bag may include a bag body of air impermeable material. The bag body may be of approximately the same height and width as the respective height and width of the main cavity. The compression bag may include a mouth. The luggage system may include a coupling structure that may be selectably coupleable about the perimeter of the secondary access aperture and may be configured to couple the mouth of the compression bag thereto, such that when so coupled and when the sealing structure is open access is available to an interior of the bag body. The coupling structure may be a zipper.

The luggage system may include a retaining system that may be configured to retain the bag body when the bag body is in a rolled configuration. The retaining system may include a retaining strap that may be selectably coupleable to one of the bag body and the luggage container. The retaining system may be fixedly coupled to the bag body and may selectably retain the bag body in a rolled configuration when the compression bag is removed from the luggage container.

According to one embodiment of the invention, there is a method of storing articles of clothing using a luggage system. The method may include the step of opening a sealing structure of a secondary access aperture of a luggage container, wherein the luggage container may have a main cavity accessible through a main access aperture. The method may include the step of placing articles of clothing within a compression bag in communication with the secondary access aperture and disposed within the main cavity. The method may also include the step of closing the sealing structure of the secondary access aperture of the luggage container. The method may include opening a main access aperture thereby accessing a main cavity of the luggage container. The method may further include the step of compressing a bag body of the compression bag and thereby expelling air out of the body bag through a valve, which may be a one-way valve, of the luggage container, the valve disposed through the sealing structure of the secondary access aperture of the luggage container.

The method of storing articles of clothing using a luggage system may include the step of coupling a retaining system of the luggage system from the body bag to the luggage container. The method may include the step of closing the main access aperture and accessing the bag body while the main access aperture is closed. The method may include the step of uncoupling a retaining system of the luggage system, decompressing the bag body and removing the articles of clothing.

The method may also include the step of providing a luggage system that may include a luggage container. The luggage container may include a main cavity that may be configured to store items therein. The luggage container may include a main access aperture that may be in communication with the main cavity. The luggage container may include a secondary access aperture that may be in communication with the main cavity. The luggage container may include a sealing structure that may be functionally coupled to the secondary access aperture, such that the secondary access aperture may be selectably sealable thereby. The luggage container may include a one-way valve that may be disposed through the sealing structure and may be configured to permit air to exit the luggage system through the sealing structure when the sealing structure is sealed and simultaneously prevent air from entering therethrough.

The luggage system may include a compression bag that may be disposed inside the main cavity and may be removably coupled to the luggage container. The compression bag may include a bag body of air impermeable material and a mouth. The luggage system may include a coupling structure that may be selectably coupleable about the perimeter of the secondary access aperture and may be configured to couple the mouth thereto, such that when so coupled and when the sealing structure is open access is available to an interior of the bag body.

The method of storing articles of clothing using a luggage system may include the step of removing the compression bag from the luggage container and removing articles of clothing therefrom. The method may include the step of zipping a mouth of the compression bag to substantially encircle the secondary aperture of the luggage container.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
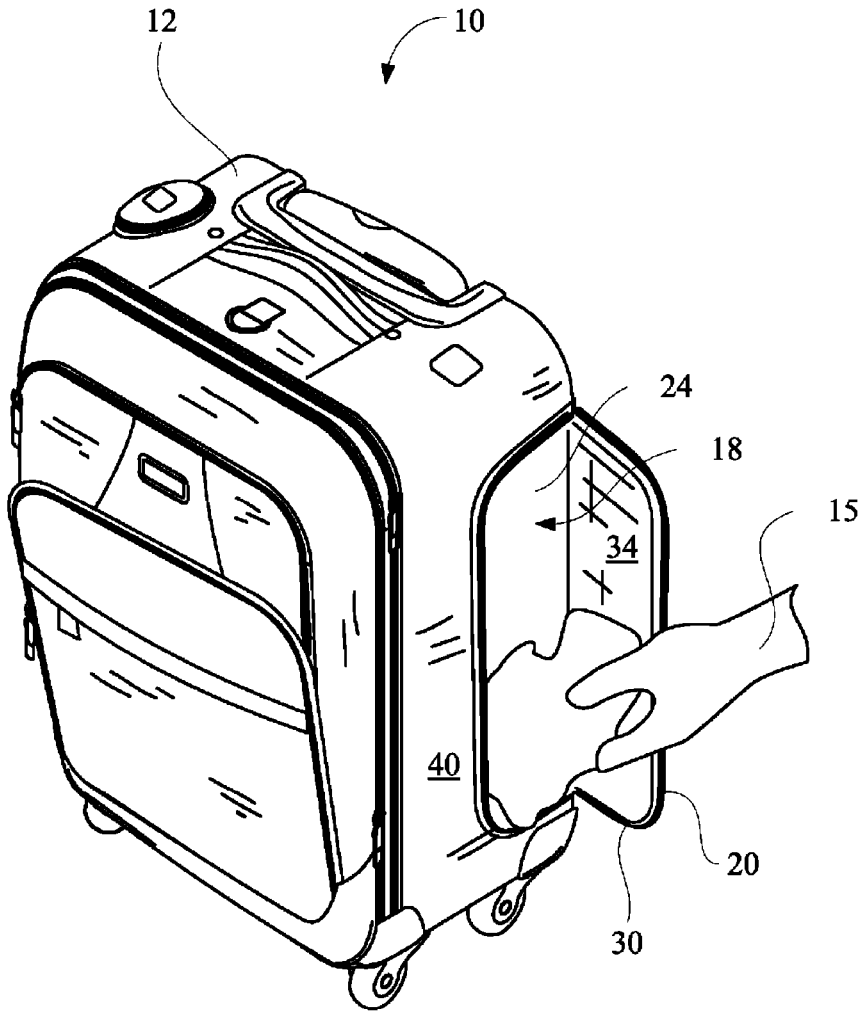
FIG. 1 is a perspective view of a user storing clothes in a compression bag of a luggage system, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in software for execution by various types of processors. An identified module of programmable or executable code may, for instance, comprise one or more physical or logical blocks of computer instructions which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module and/or a program of executable code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network.

The various system components and/or modules discussed herein may include one or more of the following: a host server or other computing systems including a processor for processing digital data; a memory coupled to said processor for storing digital data; an input digitizer coupled to the processor for inputting digital data; an application program stored in said memory and accessible by said processor for directing processing of digital data by said processor; a display device coupled to the processor and memory for displaying information derived from digital data processed by said processor; and a plurality of databases. As those skilled in the art will appreciate, any computers discussed herein may include an operating system (e.g., Windows Vista, NT, 95/98/2000, OS2; UNIX; Linux; Solaris; MacOS; and etc.) as well as various conventional support software and drivers typically associated with computers. The computers may be in a home or business environment with access to a network. In an exemplary embodiment, access is through the Internet through a commercially-available web-browser software package.

The present invention may be described herein in terms of functional block components, screen shots, user interaction, optional selections, various processing steps, and the like. Each of such described herein may be one or more modules in exemplary embodiments of the invention. It should be appreciated that such functional blocks may be realized by any number of hardware and/or software components configured to perform the specified functions. For example, the present invention may employ various integrated circuit components, e.g., memory elements, processing elements, logic elements, look-up tables, and the like, which may carry out a variety of functions under the control of one or more microprocessors or other control devices. Similarly, the software elements of the present invention may be implemented with any programming or scripting language such as C, C++, Java, COBOL, assembler, PERL, Visual Basic, SQL Stored Procedures, AJAX, extensible markup language (XML), with the various algorithms being implemented with any combination of data structures, objects, processes, routines or other programming elements. Further, it should be noted that the present invention may employ any number of conventional techniques for data transmission, signaling, data processing, network control, and the like. Still further, the invention may detect or prevent security issues with a client-side scripting language, such as JavaScript, VBScript or the like.

Additionally, many of the functional units and/or modules herein are described as being "in communication" with other functional units and/or modules. Being "in communication" refers to any manner and/or way in which functional units and/or modules, such as, but not limited to, computers, laptop computers, PDAs, modules, and other types of hardware and/or software, may be in communication with each other. Some non-limiting examples include communicating, sending, and/or receiving data and metadata via: a network, a wireless network, software, instructions, circuitry, phone lines, internet lines, satellite signals, electric signals, electrical and magnetic fields and/or pulses, and/or so forth.

As used herein, the term "network" may include any electronic communications means which incorporates both hardware and software components of such. Communication among the parties in accordance with the present invention may be accomplished through any suitable communication channels, such as, for example, a telephone network, an extranet, an intranet, Internet, point of interaction device (point of sale device, personal digital assistant, cellular phone, kiosk, etc.), online communications, off-line communications, wireless communications, transponder communications, local area network (LAN), wide area network (WAN), networked or linked devices and/or the like. Moreover, although the invention may be implemented with TCP/IP communications protocols, the invention may also be implemented using IPX, Appletalk, IP-6, NetBIOS, OSI or any number of existing or future protocols. If the network is in the nature of a public network, such as the Internet, it may be advantageous to presume the network to be insecure and open to eavesdroppers. Specific information related to the protocols, standards, and application software utilized in connection with the Internet is generally known to those skilled in the art and, as such, need not be detailed herein. See, for example, DILIP NAIK, INTERNET STANDARDS AND PROTOCOLS (1998); JAVA 2 COMPLETE, various authors, (Sybex 1999); DEBORAH RAY AND ERIC RAY, MASTERING HTML 4.0 (1997); and LOSHIN, TCP/IP CLEARLY EXPLAINED (1997), the contents of which are hereby incorporated by reference.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

FIG. 1 is a perspective view of a user storing clothes in a compression bag of a luggage system, according to one embodiment of the invention. There is shown a user 15 disposing clothes into a compression bag 24 of a luggage system 10. The illustrated luggage system 10 (as illustrated in FIG. 1 and subsequent figures) includes numerous features and structures that provide great benefits to the traveler. Advantageously, the illustrated luggage system makes it easy and convenient for the traveler to store worn clothing for later washing in a manner that is easy, that keeps the soiled clothing from the clean clothing, that permits the storage thereof without requiring the user to open the entire bag, and that solves the problem associated with ongoing clothing volume expansion associated with use, as washed and folded clothing tends to take up less space in a bag than worn clothing. Thus the user of a typical luggage system will find that they have less and less space as their trip progresses, while the user of the illustrated system is likely to find that space is actually freed up during the trip, thus making room for items that may be acquired during the trip.

The illustrated luggage system 10 is configured to store and transport clothing and personal items during travel. The luggage system 10 includes a luggage container 12 configured to store items therein. The illustrated luggage container 12 is typical in that it is a container having a semi-rigid frame that supports a spacious interior where items may be stored and includes one or more selectably sealable (usually with a zipper or snap) apertures through which to access the interior of the container. While other types of luggage containers are contemplated (hardshell, duffel bag, etc.) this type of luggage is plethoric and therefore given as a primary example of an embodiment of the invention. The illustrated luggage includes a primary/main access aperture which is basically a zippered flap that covers a front region of the container and when unzipped allows easy access to the contents thereof.

The luggage container 12 includes a secondary access aperture 18 and a sealing structure 20, functionally coupled to the secondary access aperture 18, such that the secondary access aperture 18 is selectably sealable thereby. The sealing performed by the sealing structure may be an air-tight seal, a water-tight seal, a non-air-tight seal, a non-water-tight seal, merely a coupling, and variations thereof and/or combinations thereof. The illustrated sealing structure 20 is a zipped flap 34 disposed along/through a side region 40 of the luggage container 12. Sealing structures, as used herein amongst the various structures intended to be selectably sealed may include and are not limited to zippers, snaps, ties, tongue and groove style structures (zip-lock style, or etc.), folds, adhesives applied to mating surfaces, and the like and combinations thereof. Because of the desired function of the compression bag in association with the luggage container, it is generally desired that the sealing structure of the secondary access aperture be air-tight or at least substantially resist the flow of air therethrough when sealed. The secondary access aperture beneficially allows alternative access to the interior of the luggage container and more specifically to a compression bag stored therein without requiring opening of the main access aperture.

The luggage system 10 illustrated herein these figures includes a compression bag 24 disposed inside the luggage container 12 and removably coupled to the luggage container 12. The compression bag 24 includes a mouth configured to receive materials therein, especially including articles of clothing. The mouth is generally an opening in the compression bag 24 and may be lined, unlined, may include special materials/structures about its perimeter or not, may be of a particular shape or size, and the like and combinations thereof. Generally, the mouth will be of a shape and/or size that substantially matches/conforms to/mates with or otherwise is beneficially associated with a coupling structure of the luggage container, specifically one associated with the secondary access aperture.

Thus the compression bag 24 may be joined at the mouth thereto and access to the mouth may be made through the secondary access aperture 18. The luggage system 10 includes a coupling structure 30 selectably coupleable about the perimeter of the secondary access aperture 18 and configured to couple the mouth of the compression bag 24 thereto, such that when so coupled and when the sealing structure 20 is open access is available to an interior of the compression body 24. The coupling structure 30 may include and is not limited to zippers, snaps, ties, tongue and groove style structures (zip-lock style, or etc.), folds, buckles, adhesives applied to mating surfaces, and the like and combinations thereof. However, it is generally desired that the coupling structure 30 form an air-tight seal when coupled, thus preventing or otherwise substantially restricting airflow between the interior of the compression bag and the exterior of the compression bag inside the luggage container when so coupled.

Advantageously, a traveler may place soiled or used clothing within the compression bag through a secondary access aperture therethrough. This separates such clothing from clean clothing found elsewhere in the luggage of the traveler. The traveler may be able to compress the bag and expel air therefrom through a one-way valve that extends through the sealing structure of the luggage container. Accordingly, the compression bag may be compressed to a small size and therefore not take up extra space. Further, wherein the compression bag is selectably removable from the luggage container, such as but not limited to by unzipping the sealing structure from the luggage system, a user may carry just the compression bag to the laundromat or laundry room for cleaning of the contents thereof without having to carry the entire luggage system or having to manually remove the laundry and place it in a separate container for transport.

In one embodiment, clothing during a trip is either clean and in the luggage, or disposed within the compression bag. Wherein the compression bag shares space in a main cavity of the luggage container, of the luggage system, with stored clean clothing and is selectably compressible, the total volume needed to store the clothing remains generally constant and merely selectably shifts in allocated space between the "clean" space of the interior of the main cavity of the luggage container with the "soiled" space of the compression bag that is inside the luggage container, yet separate from the clean clothing. Further, because the compression bag includes coupling members, it may be secured out of the way of other contents of the interior of the luggage container, which are likely to be free-floating therein.

In one non-limiting embodiment, there is a luggage system configured to store articles of clothing and personal items for travel. The luggage system includes a luggage container having a compression bag disposed within a main cavity of the luggage container of the luggage system. The compression bag is configured to store used articles of clothing while traveling, thereby separating the used clothing from the unused clothing. The luggage container includes a secondary access aperture, having a sealing structure, configured to provide an opening to the compression bag disposed within the luggage container from an exterior of the luggage system without having to open a main access aperture the luggage system. Such an aperture may include one or more selectably sealable structure such that one may open the sealing structure separate from the compression bag and/or may open both simultaneously. Such sealing may be airtight/fluid-tight and may include zippers or other structures for accomplishing the same.

There may be a faceplate with a logo thereon, wherein the logo design includes as a feature/element thereof a one-way air valve that is operational across a boundary defining the barrio between an inside of the luggage and an outside thereof. Accordingly, a one-way valve extending through an exterior surface of the luggage container or other structure may be concealed and/or integrated into a consistent appearance of the luggage. Such a structure may be used in an interior of a luggage and/or on a secondary access aperture of a luggage container as well. The one-way valve may functionally/simultaneously extend both through the exterior of the compression bag and the exterior of the luggage system. In one non-limiting embodiment, the logo design includes a valve that is other than one way and/or a simple aperture.

Advantageously, air expelled from the compression bag is simultaneously expelled from the luggage system and expelled through a cosmetically desirable face plate. Accordingly, a user may quickly and easily fill and compress the same without concern that air expelled will remain in the luggage system. More, the user is permitted to compress the compression bag in a variety of modes including, folding, flattening, rolling, and the like and combinations thereof.

A luggage system 10, as described herein, may include one or more of the following features, structures, benefits, and the like and combinations thereof: exterior laundry chute, compression bag with retaining system, removable laundry bag, portable mobile charger, portable mobile charger storage pouch disposed within an accessory pouch, umbrella storage pouch accessible from an exterior of the bag, a speaker storage pouch having a sound emitting surface through an exterior of the luggage container, removable toiletry kit, identifier labels on various pouches/bags/etc. for identifying where items should be stored, charger compartment, socks compartment, undergarments compartment, integrated packing checklist, water bottle pouch accessible from an exterior (and/or side) of the luggage container, magazine pouch accessible from an exterior (and/or rear) of the luggage container, a jacket wrap strap and associated coupling structure accessible from an exterior (and/or top portion) of the luggage container, and expansion structure configured to selectably enlarge the storage capacity of the luggage container by enlarging an exterior dimension (height, width, depth, etc.) of the luggage container (such as but not limited to through use of a zippered compression region), rotatable wheels, custom molded zipper pullers, neoprene extra comfort handles, two tone blended fabrics, and the like and combinations thereof.

The illustrated luggage system 10 is in a closed mode and configured to store articles of clothing and personal items for travel. The luggage system 10 includes a compression bag 24 disposed within an interior cavity of the luggage system 10. The compression bag 24 is configured to store used articles of clothing while traveling, thereby separating the used clothing from the unused clothing. The luggage system 10 includes a luggage container 12 having a sealing structure 20 configured to provide a selectably sealable opening to the compression bag 24 within the luggage container 12 of the luggage system 10 from the exterior of the luggage container 12 without having to open a main access aperture of the luggage system 10. When the sealing structure 20 is opened, a traveler/user may access the compression bag 24 by reaching inside. Alternatively, the sealing structure 20 may simultaneously open both the secondary access aperture 18 and the mouth of the compression bag 24.

Advantageously, a user may be able to dispose of soiled clothing in their hotel without having an unsightly bag of laundry laying on the floor. This is particularly advantageous for business travelers who may hold meetings/presentations in their hotel room and would prefer that their soiled clothing not be visible and/or placing an odor in the room. Further, a traveler does not need to open their whole luggage container to dispose of laundry, but may simply access the compression bag from the exterior of the bag.

Figure 2:
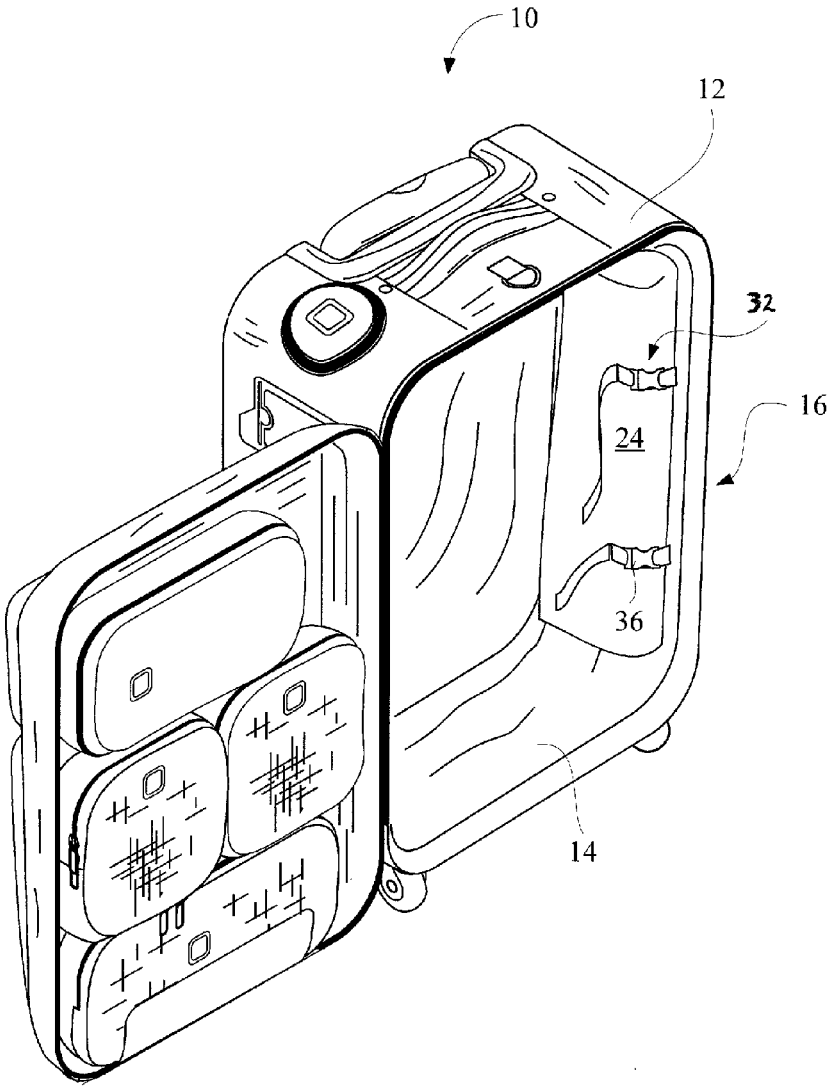
FIG. 2 is a front perspective view of a luggage system, in an open mode, including a compression bag, according to one embodiment of the invention.

FIG. 2 is a front perspective view of a luggage system, in an open mode, including a compression bag, according to one embodiment of the invention. There is shown a luggage system 10 including a luggage container 12 having a main cavity 14, a main access aperture 16, and a compression bag 24. The illustrated compression bag 24 is in a rolled/folded configuration and secured thereby with straps 36 that are coupled to the luggage system 10 and/or compression bag 24 in a manner that keeps the compression bag 24 in its rolled/folded configuration. Thus the compression bag 24 may easily remain compressed and out of the way, thereby freeing up extra storage space for other items that the traveler may desire to store.

The illustrated luggage system 10 is configured to store articles of clothing and personal items during travel. The luggage system 10 includes a luggage container 12. The luggage container 12 includes a main cavity 14 configured to store items therein. The luggage container 12 includes a main access aperture 16 that is in communication with the main cavity 14.

The luggage system 10 includes a compression bag 24 that is disposed inside the main cavity 14 and is removably coupled to the luggage container 12. The illustrated compression bag 24 is folded/rolled, and is moved out of the way and lodged against a wall of the main cavity 14, generally the same wall wherein a secondary access aperture is disposed.

The illustrated luggage system 10 includes a retaining system 32, such as a pair of retaining straps 36, that is configured to retain the compression bag 24 in a rolled configuration. The retaining system 32 includes a pair of retaining straps 36 that are selectably coupleable to one of the compression bag 24 and the luggage container 12. The retaining system 32 may be fixedly coupled to the compression bag 24 and may selectably retain the compression bag 24 in a rolled configuration when the compression bag 24 is removed from the luggage container 12. Non-limiting examples of other retaining systems include but are not limited to ties, elastic loops, tabs extending from an underside of the compression bag near the mouth and configured to mate with structures attached to the interior of the luggage container near the mouth of the compression bag such that when so mated the compression bag is rolled/folded and there retained by the mated structures, and the like and combinations thereof. A retaining system may include structure configured to allow a user to tighten/cinch the folded/rolled compression bag as or once the retaining system is retaining the compression bag. Non-limiting examples of such structure include cinch straps, adjustment device, a shortening device, a lengthening device, etc.

Figure 3:
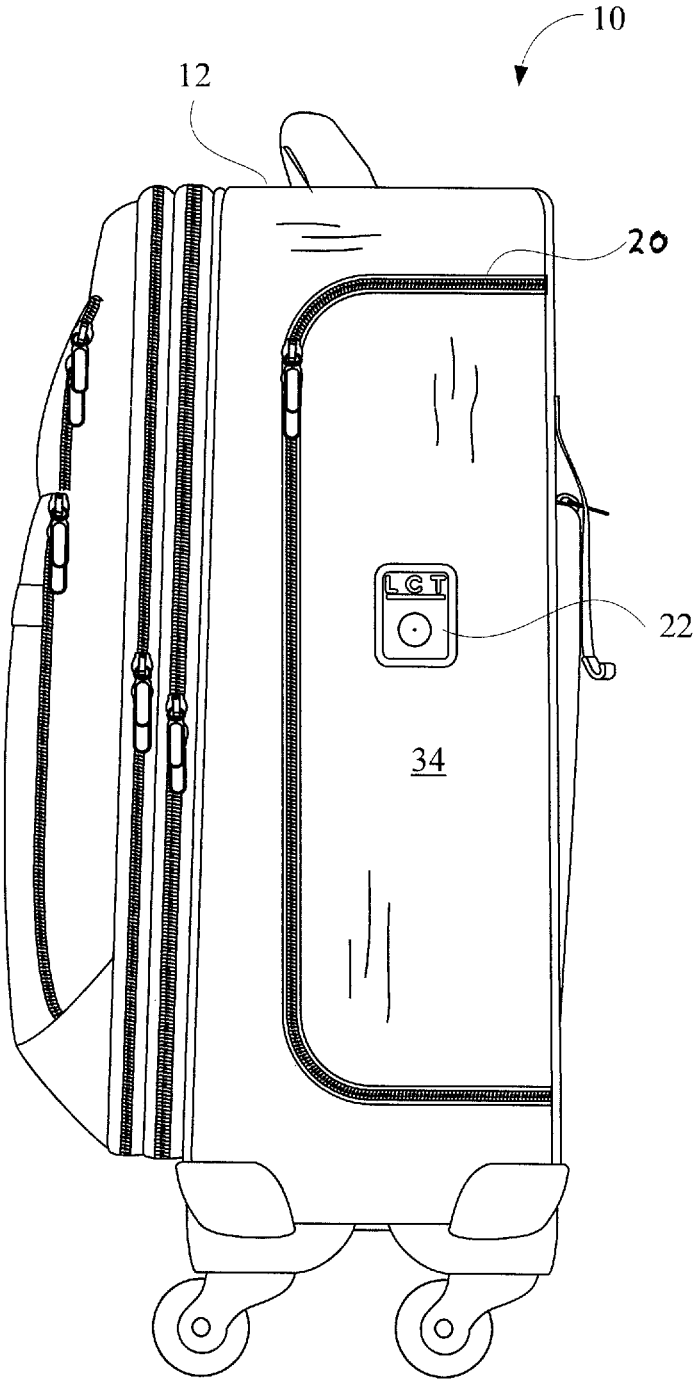
FIG. 3 is a side elevational view of a luggage system, according to one embodiment of the invention.

FIG. 3 is a side elevational view of a luggage system, according to one embodiment of the invention. There is shown a luggage system 10 including luggage container 12 having a sealing structure 20 including a one-way valve 22. The illustrated sealing structure 20 includes a zippered flap 34 having a one-way valve 22 extending through the flap 34 and thereby permitting one-way airflow therethrough to an exterior of the luggage system 10. The illustrated sealing structure 20 takes up about half of the depth of the luggage container 12.

The illustrated luggage system 10 includes a luggage container 12 having a sealing structure 20 functionally coupled to a secondary access aperture, such that the a secondary access aperture is selectably sealable thereby. The illustrated sealing structure 20 is a zipped flap 34. The luggage container 12 includes a one-way valve 22 disposed through the sealing structure 20 and configured to permit air to exit the luggage system 10 through the sealing structure 20 when the sealing structure 20 is sealed and simultaneously prevent air from entering therethrough.

Figure 4:
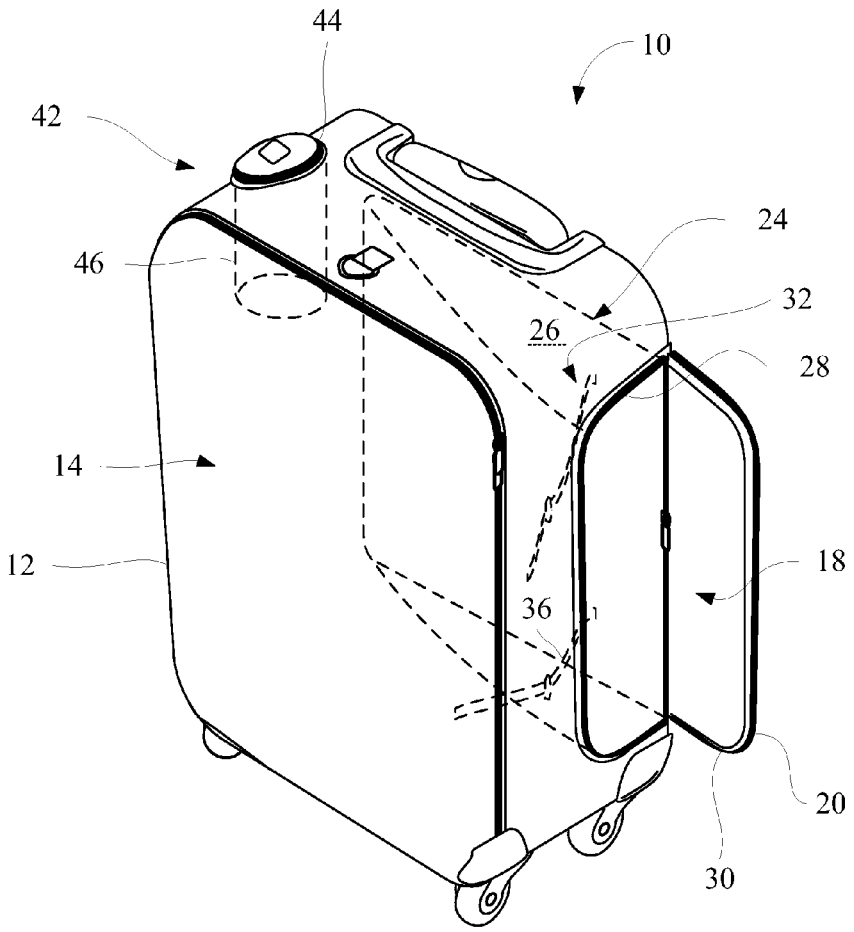
FIG. 4 is a perspective view of a compression bag disposed within a luggage container of a luggage system, according to one embodiment of the invention.

FIG. 4 is a perspective view of a compression bag disposed within a luggage container of a luggage system, according to one embodiment of the invention. There is shown a luggage system 10 including a compression bag 24 having a bag body 26 and a mouth 28. There is also shown an umbrella panel 42 for storage of an umbrella (generally a micro-travel umbrella) with access through a top aperture through the luggage container 12.

The illustrated luggage system 10 including a compression bag 24 configured to be disposed inside a main cavity 14 of a luggage container 12 of a luggage system 10. The compression bag 24 is removably coupled to the luggage container 12. The compression bag 24 includes a bag body 26 of air impermeable material. The bag body 26 is approximately the same height and width as the respective height and width of the main cavity 14. The compression bag 24 includes a mouth 28. The luggage system 10 includes a coupling structure 30 selectably coupleable about the perimeter of a secondary access aperture 18 and configured to couple the mouth 28 of the compression bag 24 thereto, such that when so coupled and when the sealing structure 20 is open access is available to an interior of the bag body 26.

The luggage system 10 includes a retaining system 32 configured to retain the bag body 26 when the bag body 26 is in a rolled configuration. The retaining system 32 includes a retaining strap 36 that is selectably coupleable to one of the bag body 26 and the luggage container 12. The retaining system 32 is fixedly coupled to the bag body 26 and is configured to selectably retain the bag body 26 in a rolled configuration when the compression bag is removed from the luggage container 12.

The illustrated umbrella panel 42 includes a cavity 46 formed by a sleeve/pocket structure. The sleeve/pocket structure may be of a soft woven material so that when not in use, the sleeve may be easily moved out of the way of storage of other items within the main cavity. Further, this also reduces the weight and cost of the umbrella panel 42. The top portion of the umbrella panel 42 includes a selectably sealable aperture 44 (generally round) accessible from an exterior of the luggage container 12 so that the umbrella may be quickly removed when needed without having to expose and/or root through the main cavity 14. The umbrella panel 42 may include an identifier, label, or other symbolic representation directing the traveler to store/retrieve the umbrella in that location.

Figure 5:
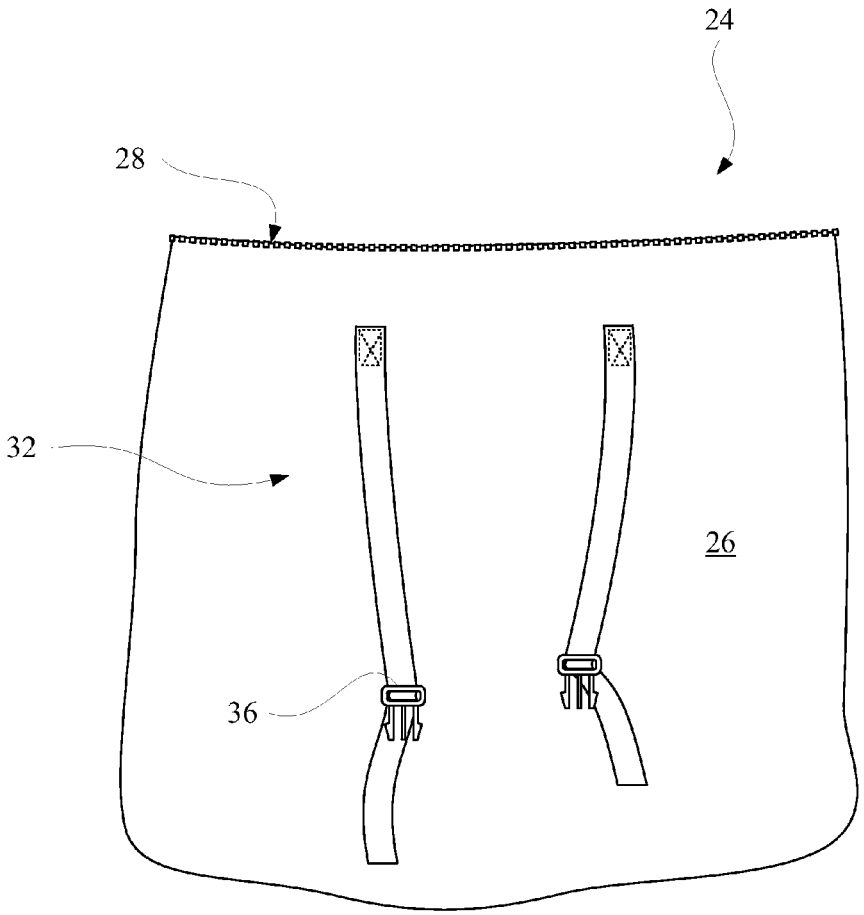
FIG. 5 is a top plan view of a compression bag of a luggage system, according to one embodiment of the invention.

FIG. 5 is a top plan view of a compression bag of a luggage system, according to one embodiment of the invention. There is shown a compression bag 24 including a bag body 26 and a mouth 28.

The compression bag 24 is configured to be disposed inside a main cavity of a luggage container of a luggage system. The compression bag 24 is removably coupled to the luggage container. The illustrated compression bag 24 includes a bag body 26 of air impermeable material. The bag body 26 is approximately the same height and width as the respective height and width of the main cavity of the luggage container. The compression bag 24 includes a mouth 28. The luggage system includes a coupling structure selectably coupleable about the perimeter of a secondary access aperture and configured to couple the mouth 28 of the compression bag 24 thereto, such that when so coupled and when the sealing structure is open access is available to an interior of the bag body 26.

The luggage system includes a retaining system 32 coupled to the compression bag 24. The retaining system 32 is configured to retain the bag body 26 when the bag body 26 is in a rolled configuration. The retaining system 32 includes a retaining strap 36 that is selectably coupleable to one of the bag body 26 and the luggage container. The retaining system 32 is fixedly coupled to the bag body 26 and is configured to selectably retain the bag body 26 in a rolled configuration when the compression bag 24 is removed from the luggage container.

The illustrated compression bag 24 is configured to store used articles of clothing. The compression bag 24 is configured to secure within a luggage container of a luggage system, such that it might be integral thereto and/or removable therefrom. A luggage system may be an article of luggage/baggage, such as but not limited to a carry-on suitcase, trunk, suit-case, upright, wheeled, upright, garment bag, tote, weekender bag, duffel bag, and or carpet bag and the like and combinations thereof.

The illustrated compression bag 24 includes a bag body 26 forms a protective barrier about the contents thereof. In one non-limiting example, the bag body 26 includes a pair of coordinated films, or planar members, that are welded at the edges, thereby forming an interior space therebetween. Such planar members may be formed of a great variety of materials, including but not limited to plastic, woven fibers, metal foil, and the like and combinations thereof, such as but not limited to composite layered materials. Plastic used therein may be of any variety and will generally be selected among materials suited for appropriate cost, durability, flexibility, smell, feel, comfort, ability to couple to other materials, fluid/air transfer rate by thickness, and the like and combinations thereof. Non-limiting examples of plastic types include but are not limited to PEVA, EVA, PU, and PVC.

The illustrated compression bag 24 includes a mouth 28 configured to extend and couple to a secondary access aperture of the luggage container, such that the compression bag 24 is accessed from an exterior of the luggage container without opening a main access aperture of the luggage container. The body bag 26 is configured to shaped and sized to fit within a main cavity of the luggage container. Accordingly, the compression bag 24 may be accessed from an exterior of the luggage container without the traveler risking that the entire soiled contents of the compression bag 24 come out of the luggage system. This permits the traveler to more discretely and conveniently exchange clothing therewith.

The luggage system includes a retaining system 32 (illustrated herein as clip-type buckles that snap into mating receiving members and may be selectably removed therefrom by depressing clip protrusions) configured to retain a bag body 26 when the bag body 26 is in a rolled configuration. The retaining system 32 includes a pair of coupling members that are sized and shaped to selectably couple to a pair of receiving members of the luggage system and secure thereto. Other coupling members that may be used (herein and elsewhere where coupling members and the like are utilized/illustrated), include but are not limited to snaps, hook and loop, buttons, clips, pins, zippers, toggles, locks, magnets, tongue and groove closures, and the like and combinations thereof. The laundry compression compartment may include a transparent surface configured to provide a view into the compartment.

The compression bag 24 includes a mouth 28 disposed on an end and is configured to provide an opening to the bag body 26 of the compression bag 24. A user may dispose objects and/or withdraw objects from the compression bag during travel. The compression bag may include a roll top closure disposed around the mouth and configured to selectably seal/close the aperture. The roll top closure is configured to roll over itself and force air from one end of the compartment to the other end, wherein it may escape through an aperture such as but not limited to a one-way air valve, zipper, hole, stitching or the like or combinations thereof. The roll top closure includes an attachment end configured to couple to a receiving end. The attachment end and the receiving end are disposed on opposite ends of the aperture and configured to selectably couple together.

Advantageously, a traveler may place soiled or used clothing within the compression bag through a secondary access aperture of the luggage container. This separates such clothing from clean clothing found elsewhere in the luggage container of the traveler. The traveler may be able to compress the bag by pressing down on the bag body and expel air therefrom through the one-way valve that extends through a sealing structure of the secondary access aperture. Accordingly, the compression bag may be compressed to a small size and therefore not take up extra space.

Figure 6:
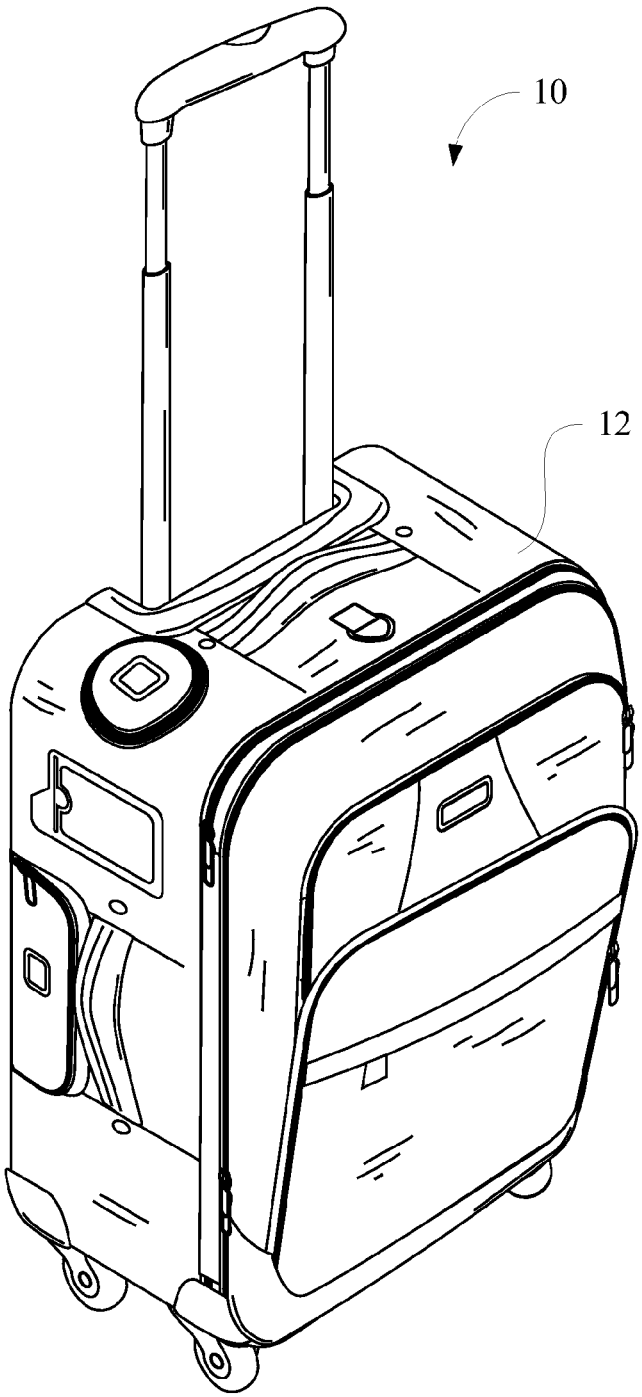
FIG. 6 is a front perspective view of a luggage system in a closed mode, according to one embodiment of the invention.

FIG. 6 is a front perspective view of a luggage system in a closed mode, according to one embodiment of the invention. There is shown a luggage system 10 including a luggage container 12.

The illustrated luggage system 10 is configured to store articles of clothing and personal items during travel. The luggage system 10 includes a luggage container 12 configured to store items therein. The illustrated luggage system 10 includes a retractable handle configured to maneuver and move the luggage system. The retractable handle may include a telescoping shaft configured to telescope within itself and retract into a main cavity of the luggage container of the luggage system.

Figure 7:
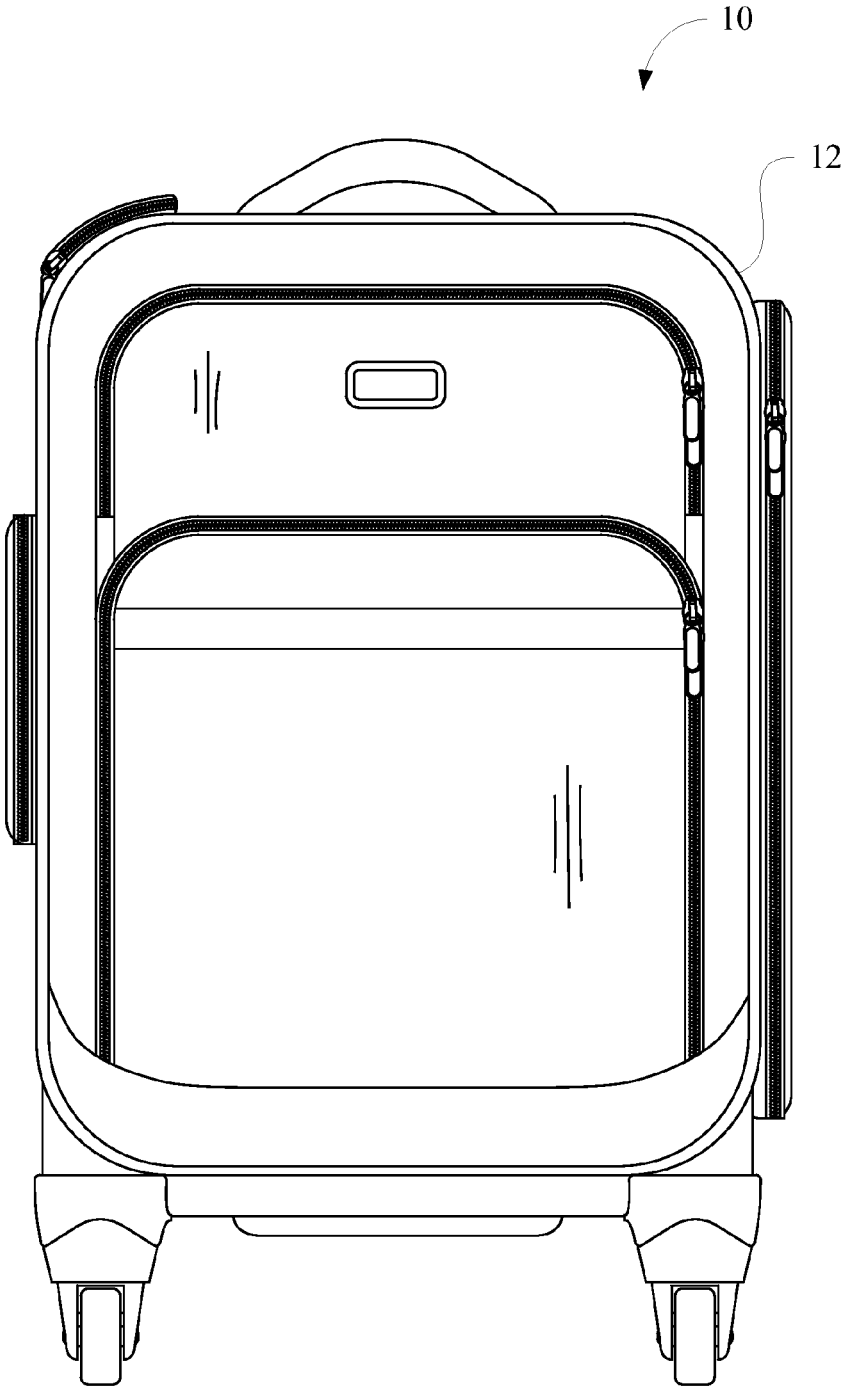
FIG. 7 is a front elevational view of a luggage system, according to one embodiment of the invention.

FIG. 7 is a front elevational view of a luggage system, according to one embodiment of the invention. There is shown a luggage system 10 including a luggage container 12.

The illustrated luggage system 10 is configured to store articles of clothing and personal items during travel. The luggage system 10 includes a luggage container 12 configured to store items therein. The luggage system 10 includes a plurality of compartments, accessible from an exterior of the luggage container 12. The compartments are configured to store articles of clothing and personal items separate from a main cavity of the luggage container 12. The illustrated luggage container 12 includes a plurality of compartments disposed about a front portion of the luggage container 12 and also along a side of the luggage container 12. The luggage container 12 also includes a fixed handle configured to support and carry the luggage system 10 during travel, without using a retractable handle.

Figure 8:
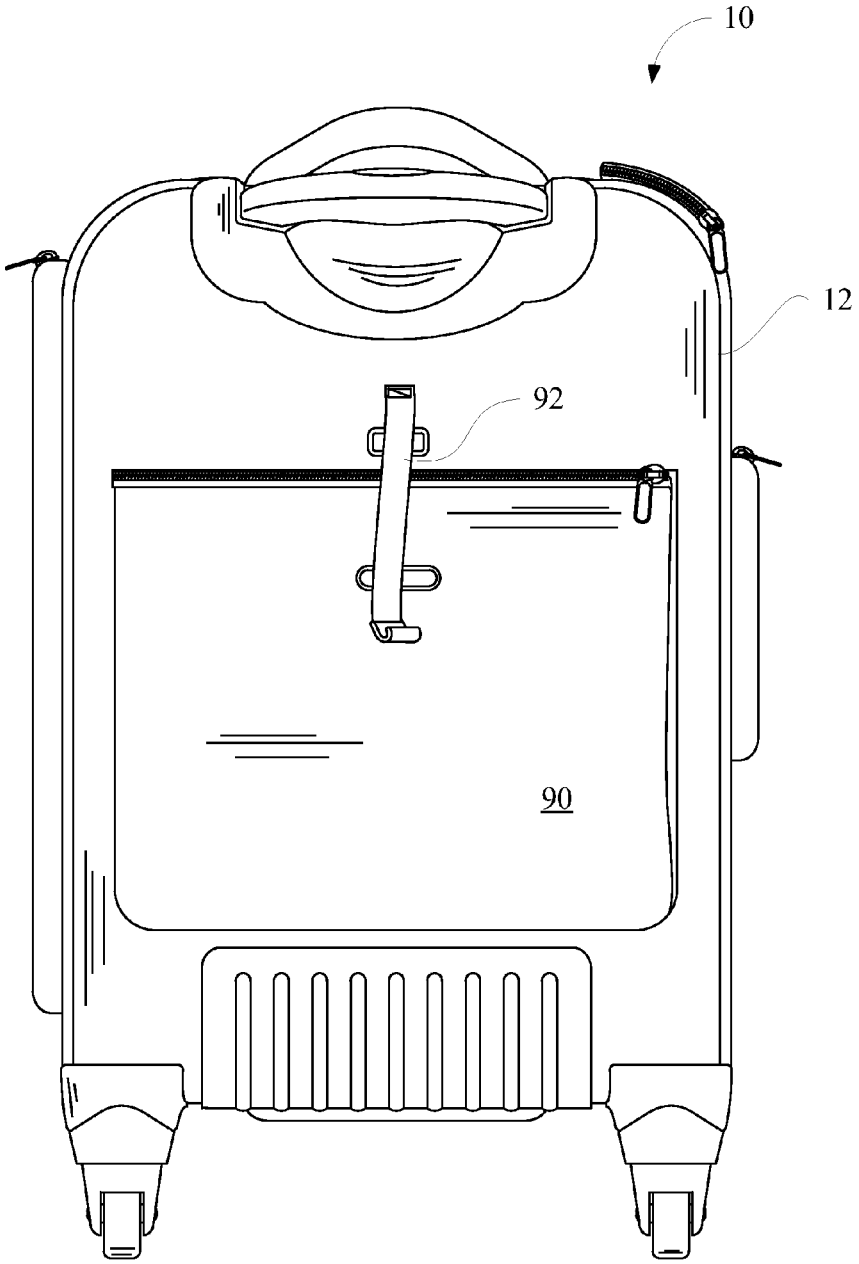
FIG. 8 is a back elevational view of a luggage system, according to one embodiment of the invention.

FIG. 8 is a back elevational view of a luggage system, according to one embodiment of the invention. There is shown a luggage system 10 including a luggage container 12.

The illustrated luggage system 10 includes a luggage container 12 configured to store articles of clothing and personal items during travel. The luggage system 10 includes a magazine pouch 90 for the convenient storage of magazines, documents, etc. without having to open the luggage container 12 or otherwise disturb any other portion of the luggage container 12. The illustrated system 10 also includes a jacket strap 92 extending from a top-central region of the rear side of the luggage container 12 exterior. The jacket strap 92 is generally elastic and includes a hook configured to hook to a front/top region of the luggage container 12, such as a fixed handle disposed about a top surface of the luggage container 12, so that a jacket or other item may be lodged in place along a top surface region of the luggage container 12 for easy storage and retrieval.

Figure 9:
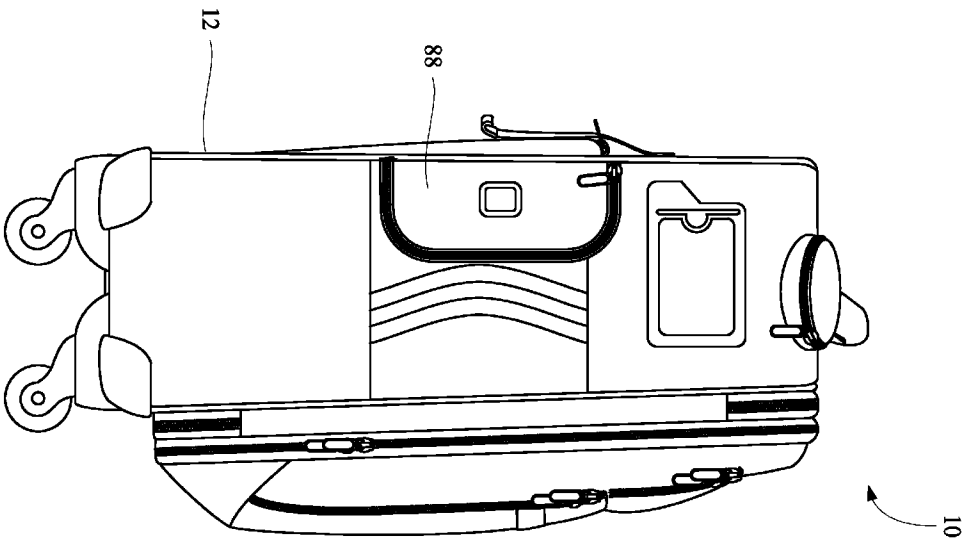
FIG. 9 is a side elevational view of a luggage system, according to one embodiment of the invention.

FIG. 9 is a side elevational view of a luggage system, according to one embodiment of the invention. There is shown a luggage system 10 including a luggage container 12 having an exterior side compartment 88.

The illustrated luggage system 10 includes a luggage container 12 having an exterior side compartment 88. The exterior side compartment 88 is configured to store articles of clothing or personal items. The exterior side compartment 88 may be configured to store and support a beverage or water bottle during travel. The exterior side compartment 88 includes a selectably sealable aperture configured to selectably seal the side exterior compartment 88 when not in use.

Figure 10:
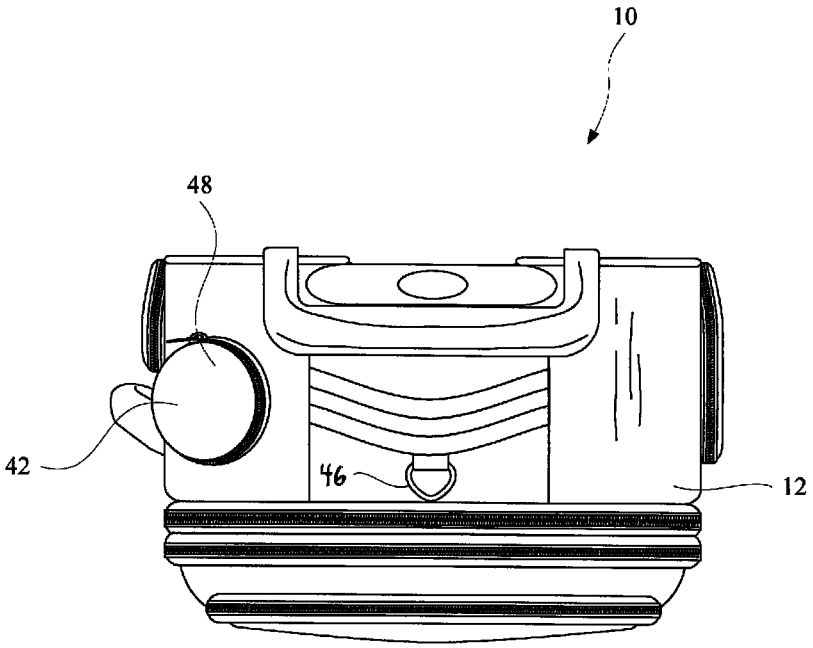
FIG. 10 is a top plan view of a luggage system, according to one embodiment of the invention.

FIG. 10 is a top plan view of a luggage system, according to one embodiment of the invention. There is shown a luggage system 10 including a luggage container 12.

The illustrated luggage system 10 is configured to store articles of clothing and personal items during travel. The luggage system 10 includes a luggage container 12 configured to store items therein. The illustrated luggage system 10 includes an umbrella compartment 42 configured to store an umbrella. The umbrella compartment 42 includes a cylindrical container housed within the luggage container 12 and having a selectably sealable aperture 48 (illustrated as a circular zipper flap) through the body of the luggage container 12 such that the cylinder may be accessed from an exterior of the luggage system 10.

The illustrated umbrella compartment 42 is disposed within a top portion of the luggage container 12. The umbrella compartment 42 is configured to provide a place to store an umbrella during travel. The umbrella compartment 42 includes a housing sized and shaped to receive an umbrella. The umbrella compartment 42 is configured to receive a retractable umbrella, such as a small compact umbrella. The umbrella compartment 42 includes a selectably sealable aperture 48 configured to cover or uncover the umbrella compartment 42, thereby securing the umbrella therein. The umbrella compartment 42 may include sidewalls and/or bottom that may be flexible and/or non-flexible and may be of a variety of materials. In one non-limiting example, the umbrella compartment may consist of a nylon fabric tube coupled to the luggage. In one non-limiting embodiment, the umbrella compartment may include a spring/bias mechanism configured to cooperate with the umbrella and facilitate storage and/or retrieval.

Advantageously, the stored umbrella may be accessible without opening the luggage and may be safely and securely housed therein. Further, the user need not spend any extra time finding the umbrella amongst other free-floating articles in the luggage. Further, when you remove the umbrella and the umbrella compartment is flexible, it may be moved out of the way and thereby not take up any substantial space within the luggage.

In one non-limiting embodiment, the umbrella compartment includes a spring loaded mechanism disposed about a bottom portion thereof, configured to dispense an umbrella. The umbrella compartment is configured to receive an umbrella and lock the spring loaded mechanism in a downward position in a first mode, when force is applied thereto. The spring loaded mechanism is also configured to release the umbrella, after being locked in the first mode, when force is again applied to a top portion of the umbrella in a downward direction, the spring loaded mechanism is configured to unlock and push the umbrella up and out of the compartment.

Advantageously, the umbrella may be stowed safely and conveniently within ones luggage and may be removed therefrom easily when needed, without needing to open the shell of the luggage. Umbrellas are particularly vulnerable to breaking during storage and handling and therefore the illustrated invention advantageously extends lifecycles of such.

The illustrated luggage system 10 includes a securement loop 46 configured to selectably couple to a jacket strap. The securement loop 46 is coupled to a fixed handle of the luggage container 12. The jacket strap is generally elastic and includes a hook configured to hook to the securement loop disposed about a front/top region of the luggage container 12, so that a jacket or other item may be lodged in place along a top surface region of the luggage container 12 for easy storage and retrieval.

Figure 11:
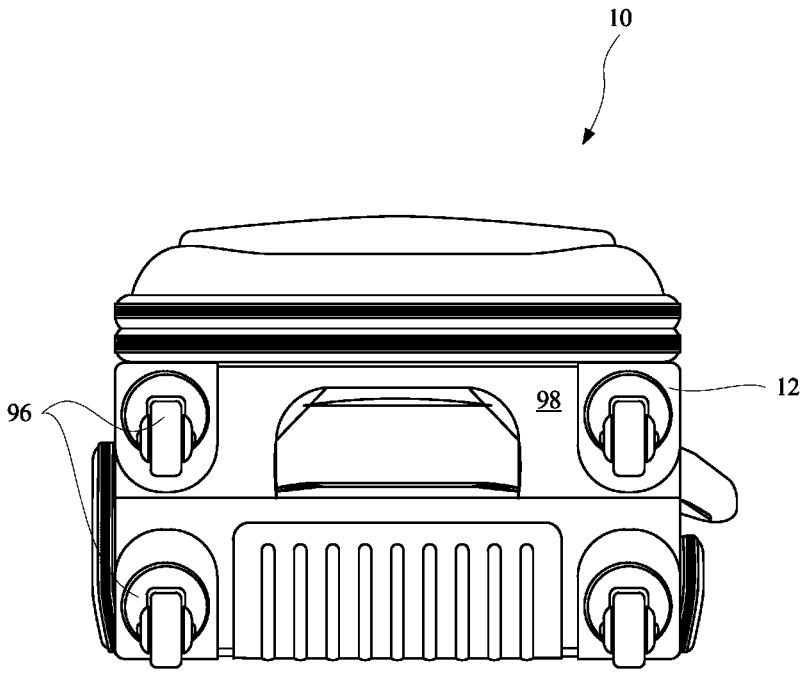
FIG. 11 is a bottom plan view of a luggage system, according to one embodiment of the invention.

FIG. 11 is a bottom plan view of a luggage system, according to one embodiment of the invention. There is shown a luggage system 10 including a luggage container 12.

The illustrated luggage system 10 includes a luggage container 12 configured to store articles of clothing and personal items therein. The luggage container 12 includes a plurality of swiveling wheels 96 disposed at a bottom portion 98 thereof. The plurality of swiveling wheels 96 are configured to assist in maneuvering and transporting the luggage system 10.

Figure 12:
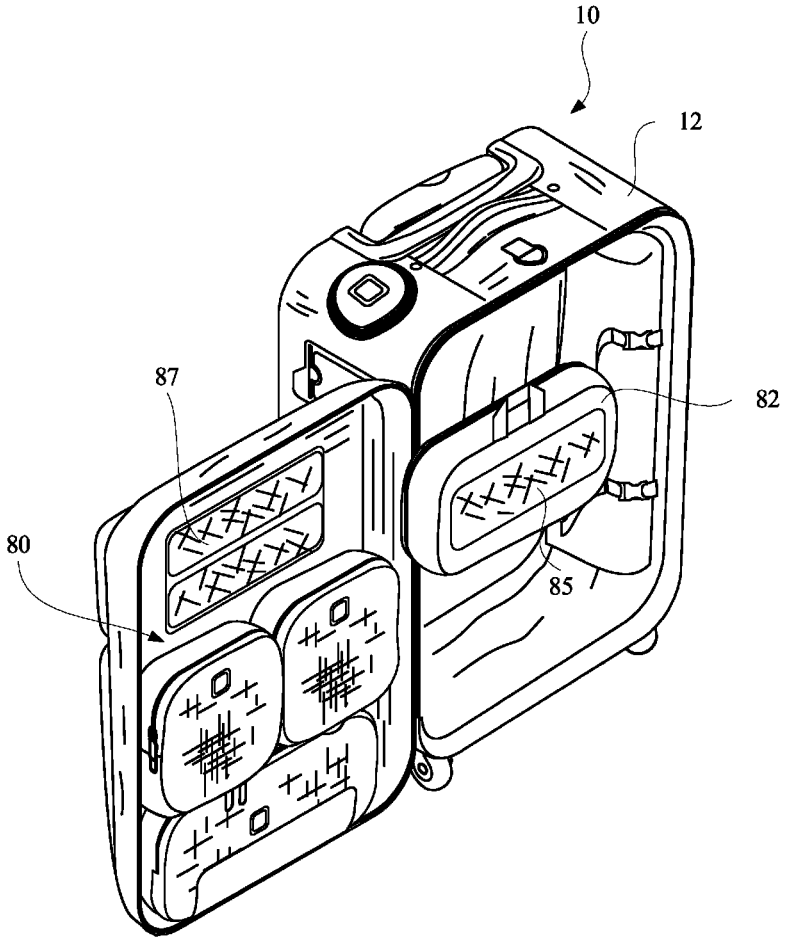
FIG. 12 is a perspective view of a luggage system in an open mode, according to one embodiment of the invention.

FIG. 12 is a perspective view of a luggage system in an open mode, according to one embodiment of the invention. There is shown a luggage system 10 including luggage container 12 having a removable toiletry kit 80 having a plurality of storage pockets/regions 82 wherein toiletries may be stored.

The illustrated luggage system 10 includes a luggage container 12 configured to store articles of clothing or personal items therein. The luggage container 12 includes a removable toiletry kit 80 selectably coupled to the luggage container 12 in a variety of ways. In one non-limiting embodiment, the toiletry kit 80 is stored within a selectably sealable pouch accessible from an exterior of the luggage container and held in place by a coupling device, such as but not limited to a hook-and-loop (as in the brand name Velcro) patch coupled to an interior surface of the pouch and a mating patch coupled to a rear exterior surface of the kit container.

The removable toiletry kit 80 includes a plurality of storage pockets/regions 82 configured to store articles of clothing or personal items during travel. The plurality of storage pockets/regions 82 each include a coupling surface 85 disposed about a rear exterior side of each storage pocket/region configured to selectably couple to the luggage container 12. The luggage container 12 includes a plurality of receiving surfaces 87 disposed about an interior surface of a main access cover, configured to selectably couple to the coupling surface of a storage pocket/region 82.

Figure 13:
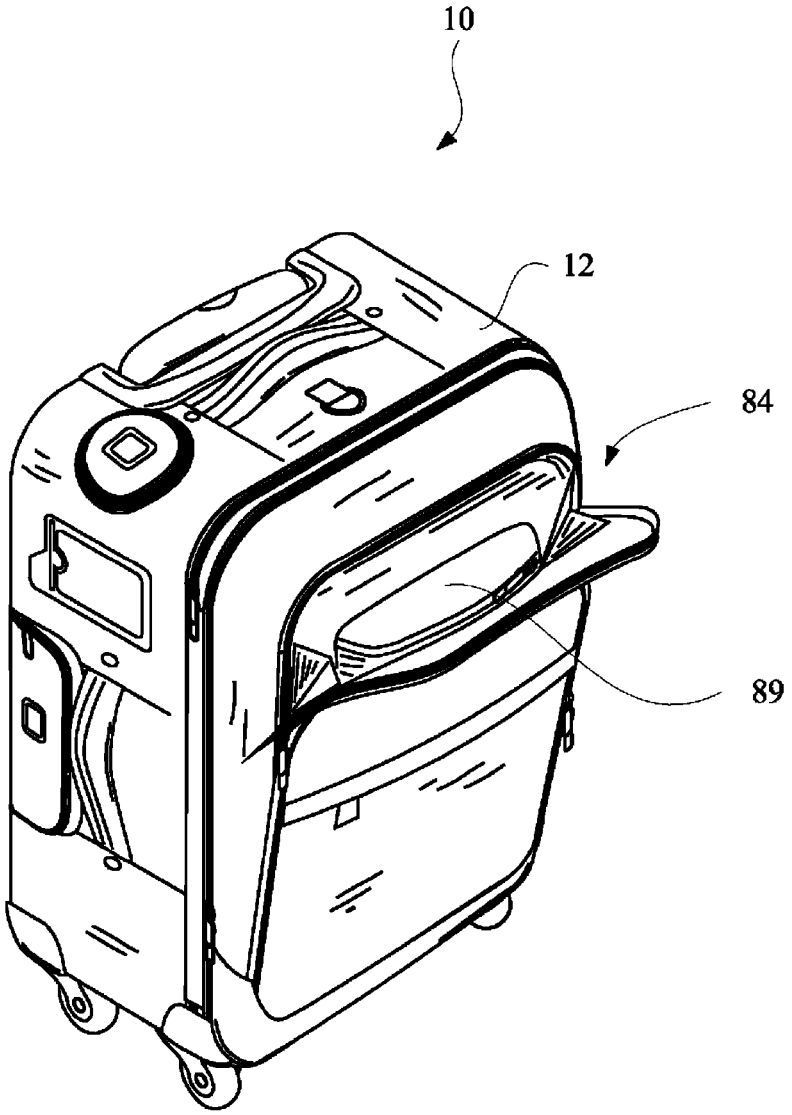
FIG. 13 is a front perspective view of a front exterior compartment of a luggage system, according to one embodiment of the invention.

FIG. 13 is a front perspective view of a front exterior compartment of a luggage system, according to one embodiment of the invention. There is shown a luggage system 10 including a luggage container 12 having a front exterior compartment 84.

The illustrated luggage system 10 is configured to store articles of clothing and personal items during travel. The luggage system 10 includes a luggage container 12 having a front exterior compartment 84. The front exterior compartment 84 is configured to be sized and shaped to store items therein, in particular to store accessories, such as but not limited to electronic devices, smartphones, mp3 players, and the like and combinations thereof. The front exterior compartment 84 may include padding disposed within the front exterior compartment 84 configured to protect the contents therein during travel.

According to one embodiment of the invention, the luggage system includes a power charging module disposed within a front exterior compartment of the luggage container. The front exterior compartment is configured to be sealed by a protective cover configured to selectably cover and uncover the front compartment. Such may cover in stages, such that in one stage nothing is exposed, in another stage one or more power coupling members are exposed, and in another stage the entire unit may be accessible, and in yet another stage the entire unit may be removed.

The power charging module is configured to provide a rechargeable power source to the luggage system. The power charging module includes a power output device such as a USB connector, micro USB connector, mini USB connector, 30-pin iPhone connector, and/or other power output formats for charging cell-phones, smartphones, and other electronic devices. The illustrated power charging module includes a plurality of connectors configured to couple to a plurality of various electronic devices. The power charging module includes a selectably removable and rechargeable power source disposed within the luggage system. The power charging module is configured to provide a charging station to a user from an exterior of the luggage system, without having to connect to a power outlet or have to open up the luggage system. In one non-limiting embodiment, a power charging module is charged/recharged by coupling through USB to a computer and/or through a power coupling to a wall outlet.

Advantageously, a user may conveniently and discretely charge electronic devices from their luggage without having to carry separate devices and/or deal with tangling cords from disorganized systems. Additionally, the user may be able to charge one or more devices even when access to a power outlet is not available.

According to one embodiment of the invention, the luggage system includes a luggage container having an audio module including a speaker module and a control module. The speaker module and the control module are in communication with a power charging module. The audio module is configured to couple to an electronic device, such as an MP3 player, mobile phone, smartphone, iPod, and etc. The audio module includes a communication module configured to transmit data, such as music data, from the MP3 player to the speaker module. The control module is configured to provide operational controls to the speaker module and to the MP3 player. The speaker module is configured to broadcast audio from the MP3 player or other electronic device. The power charging module is configured to charge the power module of the MP3 player, or other electronic device. The audio module and the power charging module may be disposed on an interior of the luggage system, and may also be disposed on an exterior of the luggage system. In one non-limiting embodiment, the user may retract an audio player and/or audio module and hold it manually or otherwise use it from an exterior of the luggage.

In one embodiment, there may be a plurality of compartments for speakers that may be functionally (e.g. electrically by wire) coupled to a control module compartment wherein a control module (e.g. MP3 player) controls play of audio over the speakers. Speakers may be removable from their compartments and removing may disconnect the speakers from the control module. There may be one or more coupling sockets that receive coupling members of speakers such that the speakers may be mounted into a data port inside a compartment, wherein the data port is coupled to the control module. Advantageously, a user may be able to play music from their luggage in a convenient and discrete manner.

According to one embodiment of the invention, there is a luggage system configured to store articles of clothing and personal items for travel. The luggage system may include a selectably removable front exterior compartment 89 configured to, and may be used to, store and support a pair of sunglasses, eyeglasses, other accessories, and etc. The selectably removable compartment 89 is configured to be a protective eyeglass case selectably removable from a luggage system. The selectably removable compartment 89 may include compression molded foam, injection molded EVA foam, or sewn in foam lining. The selectably removable compartment 89 may include an injection molded hard shell comprising polypropylene or ABS plastic. The selectably removable compartment 89 may be selectably coupled to the luggage system by a hook and loop coupling device, such as but not limited to Velcro, magnets, straps, anchors, clips, clamps, etc. There is shown a selectably removable compartment nestled within a cavity in the front exterior compartment of the luggage system such that the selectably removable compartment does not substantially protrude therefrom.

Advantageously, such a compartment may be easily accessible and may also be removable for portage when one desires to leave the main luggage body behind. More, such a selectably removable compartment may be stored securely with the luggage and may be removed therefrom when desired without the user being concerned that routine encounters of the luggage with other materials will dislodge the selectably removable compartment.

Figure 14:
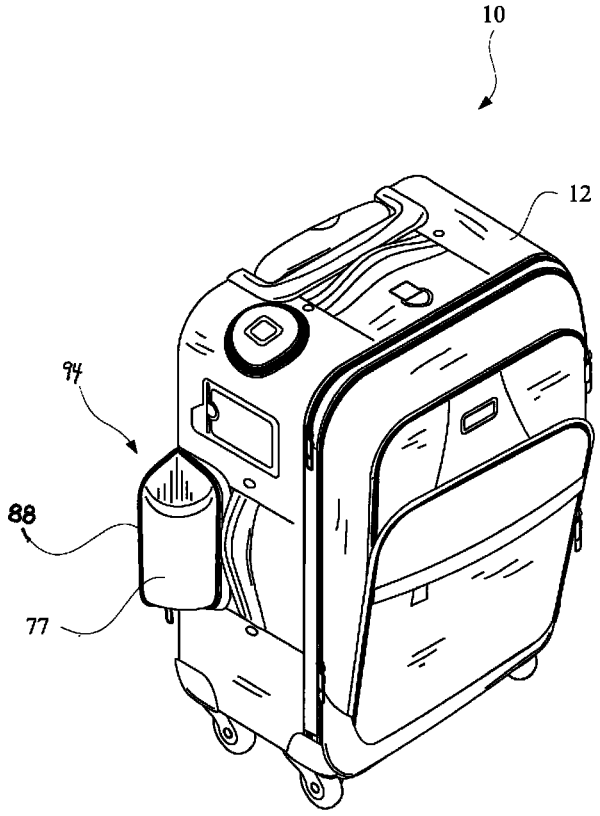
FIG. 14 is a side perspective view of an exterior side compartment of a luggage system, according to one embodiment of the invention.

FIG. 14 is a side perspective view of an exterior side compartment of a luggage system, according to one embodiment of the invention. There is shown a luggage system 10 including a luggage container 12 having a beverage holder 94.

The illustrated luggage system 10 is in a closed mode and configured to store articles of clothing and personal items for travel. The luggage system 10 includes an exterior side compartment 88 configured to secure and store a beverage or a water bottle. The beverage holder 94 includes a inwardly folded sleeve 77 that may be collapsed into the exterior side compartment 88 that then flatly couples the side compartment when not in use, but then when opened, the sleeve 77 may fold outward thus providing an enlarged storage capacity for a beverage or a water bottle during travel. Advantageously, the beverage or water bottle is accessible during use without requiring the user to open the main cavity and root therethrough, but when the water bottle compartment is not in use, then the exterior dimensions of the luggage container are reduced, thus making it easier to have maximum storage capacity while still being within travel guidelines (such as maximum size for a carry-on luggage article).

Figure 15:
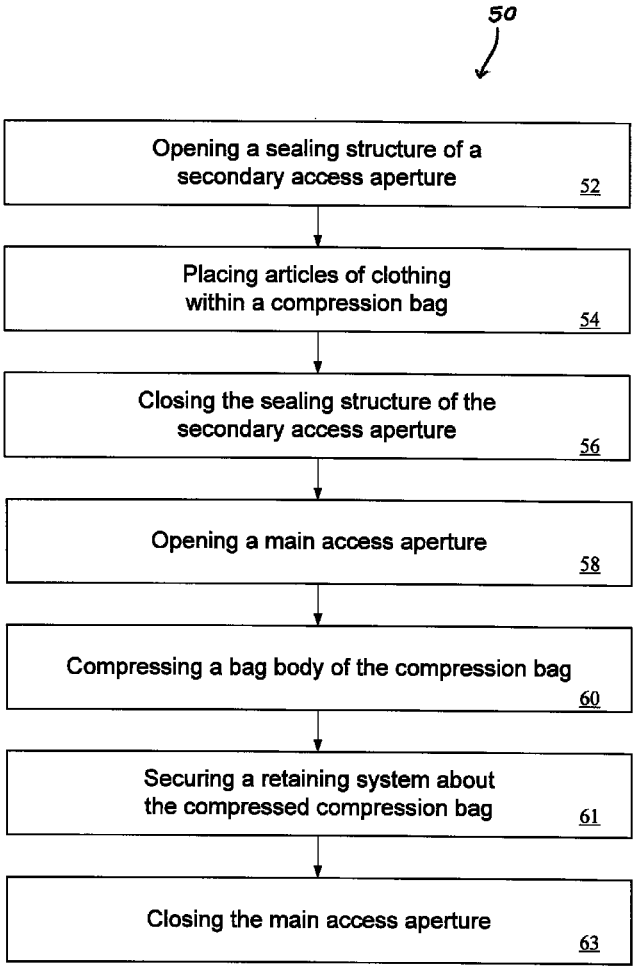
FIG. 15 is a flow chart of a method of storing articles of clothing using a luggage system, according to one embodiment of the invention.

FIG. 15 is a flow chart of a method of storing articles of clothing using a luggage system, according to one embodiment of the invention. There is shown a method of storing articles of clothing using a luggage system 50.

The illustrated method of storing articles of clothing using a luggage system 50 includes the step of opening a sealing structure of a secondary access aperture of a luggage container 52. The luggage container also includes a main cavity accessible through a main access aperture. The method 50 includes the step of placing articles of clothing within a compression bag 54 in communication with the secondary access aperture and which is disposed within the main cavity.

The illustrated method includes the step of closing the sealing structure of the secondary access aperture of the luggage container 56, thereby securing the articles of clothing within the compression bag within a luggage container of the luggage system. The method 50 includes opening a main access aperture 58 thereby accessing a main cavity of the luggage container. The method of storing articles of clothing using a luggage system 50 includes the step of compressing a bag body of the compression bag 60 and thereby expelling air out of the body bag through a valve (which may be a one-way valve) of the luggage container, the valve disposed through the sealing structure of the secondary access aperture of the luggage container.

The illustrated method 50 includes the step of securing a retaining system about the compressed compression bag 61. The illustrated compression bag is folded/rolled, and is moved out of the way and lodged against a wall of the main cavity of the luggage container, generally the same wall wherein a secondary access aperture is disposed. The method of storing articles of clothing using a luggage system may include the step of coupling a retaining system of the luggage system from the body bag to the luggage container.

The illustrated method 50 includes the step of closing the main access aperture 63 and accessing the bag body while the main access aperture is closed. The method may include the step of uncoupling a retaining system of the luggage system, decompressing the bag body and removing the articles of clothing.

The method may also include the step of providing a luggage system that may include a luggage container. The luggage container may include a main cavity that may be configured to store items therein. The luggage container may include a main access aperture that may be in communication with the main cavity. The luggage container may include a secondary access aperture that may be in communication with the main cavity. The luggage container may include a sealing structure that may be functionally coupled to the secondary access aperture, such that the secondary access aperture may be selectably sealable thereby. The luggage container may include a one-way valve that may be disposed through the sealing structure and may be configured to permit air to exit the luggage system through the sealing structure when the sealing structure is sealed and simultaneously prevent air from entering therethrough.

The luggage system may include a compression bag that may be disposed inside the main cavity and may be removably coupled to the luggage container. The compression bag may include a bag body of air impermeable material and a mouth. The luggage system may include a coupling structure that may be selectably coupleable about the perimeter of the secondary access aperture and may be configured to couple the mouth thereto, such that when so coupled and when the sealing structure is open access is available to an interior of the bag body.

The method of storing articles of clothing using a luggage system may include the step of removing the compression bag from the luggage container and removing articles of clothing therefrom. The method may include the step of zipping a mouth of the compression bag to substantially encircle the secondary aperture of the luggage container.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although a particular type of luggage is illustrated, in particular, one suited as a carry-on luggage for travel by plane, other types of luggage may employ one or more of the features, structures, systems, methods, devices, and the like described herein and such luggage may vary in size and shape from the illustrated luggage of the figures.

Additionally, although the figures illustrate specific aesthetic characteristics of a luggage, it is understood that the aesthetic characteristics are plethoric and may be varied greatly from luggage to luggage.

It is also envisioned that luggage may include one or more features described herein and/or may specifically not include one or more of the features described herein.

Finally, it is envisioned that the components of the device may be constructed of a variety of materials, including but not limited to plastics, rubbers, metals, organic materials, nylon, PVC, polyester, natural fibers, synthetic fibers, woven materials, braided materials, ceramics, composites, and the like and combinations thereof.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. A luggage system, comprising:

a) a luggage container, including:

a1) a main cavity configured to store items therein;

a2) a main access aperture in communication with the main cavity;

a3) a secondary access aperture in communication with the main cavity;

a4) a sealing structure functionally coupled to the secondary access aperture, such that the secondary access aperture is selectably sealable thereby; and a5) a valve disposed through the sealing structure configured to permit air to exit the luggage system through the sealing structure when the sealing structure is sealed;

b) a compression bag disposed inside the main cavity and removably coupled to the luggage container, including:

b1) a bag body of air impermeable material; and b2) a mouth;

c) a coupling structure selectably coupleable about the perimeter of the secondary access aperture and configured to couple the mouth of the compression bag thereto, such that when so coupled and when the sealing structure is open access is available to an interior of the bag body; and d) a retaining system configured to retain the bag body when the bag body is in a rolled configuration.

2. The system of claim 1, wherein the sealing structure is a zipped flap and wherein the valve is a one-way valve.

3. The system of claim 1, wherein the retaining system includes a retaining strap selectably coupleable to one of the bag body and the luggage container.

4. The system of claim 1, wherein the coupling structure is a zipper.

5. The system of claim 1, wherein the bag body is of approximately the same height and width as the respective height and width of the main cavity.

6. The system of claim 1, wherein the retaining system is fixedly coupled to the bag body and selectably retains the bag body in a rolled configuration when the compression bag is removed from the luggage container.

7. A luggage system, comprising:

a) a luggage container, including:

a1) a main cavity configured to store items therein;

a2) a main access aperture in communication with the main cavity;

a3) a secondary access aperture in communication with the main cavity;

a4) a sealing structure functionally coupled to the secondary access aperture, such that the secondary access aperture may be setectably sealable thereby; and a5) a one-way valve disposed through the sealing structure configured to permit air to exit the luggage system through the sealing structure when the sealing structure is sealed and simultaneously prevent air from entering therethrough;

b) a compression bag disposed inside the main cavity and removably coupled to the luggage container, including:

b1) a bag body of air impermeable material; and b2) a mouth; and c) a coupling structure selectably coupleable about the perimeter of the secondary access aperture and configured to couple the mouth thereto, such that when so coupled and when the sealing structure is open access is available to an interior of the bag body.

8. The system of claim 7, wherein the bag body is of approximately the same height and width as the respective height and width of the main cavity.

9. The system of claim 8, wherein the sealing structure is a zipped flap.

10. The system of claim 9, wherein the retaining system is fixedly coupled to the bag body and selectably retains the bag body in a rolled configuration when the compression bag is removed from the luggage container.

11. The system of claim 10, wherein the coupling structure is a zipper.

12. The system of claim 11, further comprising a retaining system configured to retain the bag body when the bag body is in a rolled configuration.

13. The system of claim 12, wherein the retaining system includes a retaining strap selectably coupleable to one of the bag body and the 5 luggage container.

14. A method of storing articles of clothing using a luggage system, comprising the steps of:

a) opening a sealing structure of a secondary access aperture of a luggage container, the luggage container having a main cavity accessible through a main access aperture;

b) placing articles of clothing within a compression bag in communication with the secondary access aperture and disposed within the main cavity;

c) closing the sealing structure of the secondary access aperture of the luggage container;

d) opening a. main access aperture thereby accessing a main cavity of the luggage container; and e) compressing a bag body of the compression bag and thereby expelling air out of the body bag through a valve of the luggage container, the valve disposed through the sealing structure of the secondary access aperture of the luggage container.

15. The method of claim 14, further comprising the step of coupling a retaining system of the luggage system from the body bag to the luggage container.

16. The method of claim 14, further comprising the step of closing the main access aperture and accessing the bag body while the main access aperture is closed.

17. The method of claim 14, further comprising the step of uncoupling a retaining system of the luggage system, decompressing the bag body and removing the articles of clothing.

18. The method of claim 14, further comprising the step of providing a luggage system, comprising:

a) a luggage container, including:

a1) a main cavity configured to store items therein;

a2) a main access aperture in communication with the main cavity;

a3) a secondary access aperture in communication with the main cavity;

a4) a sealing structure functionally coupled to the secondary access aperture, such that the secondary access aperture may be selectably sealable thereby; and a5) a one-way valve disposed through the sealing configured to permit air to exit the luggage system through the sealing structure when the sealing structure is sealed and simultaneously prevent air from entering therethrough;

b) a compression bag disposed inside the main cavity and removably coupled to the luggage container, including:

b1) a bag body of air impermeable material; and b2) a mouth; and c) a coupling structure selectably coupleable about the perimeter of the secondary access aperture and configured to couple the mouth thereto, much that when so coupled and when the sealing structure is open access is available to an interior of the bag body.

19. The method of claim 14, further comprising the step of removing the compression bag from the luggage container and removing articles of clothing therefrom.

20. The method of claim 14, further comprising the step of zipping a mouth of the compression bag to substantially encircle the secondary aperture of the luggage container.

* * * * *